US010391615B2

(12) United States Patent
Hsieh

(10) Patent No.: US 10,391,615 B2
(45) Date of Patent: Aug. 27, 2019

(54) ROTATABLE FASTENING DEVICE

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 372 days.

(21) Appl. No.: 15/194,555

(22) Filed: Jun. 27, 2016

(65) Prior Publication Data

US 2017/0297178 A1 Oct. 19, 2017

(30) Foreign Application Priority Data

Apr. 13, 2016 (TW) ..... 105111503 A

(51) Int. Cl.
*B25B 21/02* (2006.01)
*B25B 13/06* (2006.01)
*B25B 23/147* (2006.01)

(52) U.S. Cl.
CPC ..... *B25B 21/02* (2013.01); *B25B 13/06* (2013.01); *B25B 23/1475* (2013.01)

(58) Field of Classification Search
CPC .... B25C 1/06; B25C 5/15; B25C 1/00; B25B 21/02; B25B 23/0035; B25B 23/1475; B25B 13/06
USPC ..... 173/1, 2, 93, 176, 179, 183, 217; 227/119–133; 81/12.1, 124.6
See application file for complete search history.

(56) References Cited

U.S. PATENT DOCUMENTS 3,735,824 A * 5/1973 Astrom ..... B23Q 1/015 175/213
3,881,838 A * 5/1975 Derbyshire ..... B23B 31/001 408/241 G
4,068,377 A * 1/1978 Kimmel ..... A01D 34/416 30/276
4,075,927 A * 2/1978 Frazier ..... B23B 31/261 279/142
4,213,621 A * 7/1980 Fink ..... B23B 31/14 279/110
4,291,425 A * 9/1981 Sweitzer ..... B25B 13/005 7/100
4,800,786 A * 1/1989 Arnold ..... B25B 13/06 81/121.1
4,836,059 A * 6/1989 Arnold ..... B25B 13/06 76/114
4,979,355 A * 12/1990 Ulevich ..... B25B 13/06 81/121.1
5,310,341 A * 5/1994 Byer ..... A61C 3/02 433/116

(Continued)

FOREIGN PATENT DOCUMENTS

TW I520817 B 2/2016

*Primary Examiner* — Robert F Long
(74) *Attorney, Agent, or Firm* — CKC & Partners Co., LLC

(57) ABSTRACT

A rotatable fastening device includes a rotatable base and an impact member. The rotatable base rotates along a pivoting axis, and the rotatable base is removably connected with and driving a rotatable member. The impact member is removably connected to an outside of the rotatable base, and the impact member has at least one gravity unit projected outwardly therefrom. The gravity unit is driven by the rotatable base to rotate around the pivoting axis for generating a tangent impact force.

10 Claims, 7 Drawing Sheets

(56) References Cited

U.S. PATENT DOCUMENTS 5,328,308 A * 7/1994 Ducker, III ..... B23B 31/005 407/30
5,405,221 A * 4/1995 Ducker, III ..... B23B 31/005 279/83
5,772,367 A * 6/1998 Daniel ..... B23Q 11/0046 173/75
5,842,651 A * 12/1998 Smothers ..... A01G 3/002 241/27
5,862,658 A * 1/1999 Howard ..... A01D 34/84 172/111
5,906,149 A * 5/1999 Montenegro Criado ..... B26D 7/20 83/346
5,957,012 A * 9/1999 McCune ..... B25B 13/56 81/180.1
6,120,220 A * 9/2000 Speare ..... B23B 51/05 408/1 R
6,139,228 A * 10/2000 Longo ..... A61B 17/162 279/150
6,220,115 B1 * 4/2001 Hirn ..... F16H 49/001 74/640
6,328,505 B1 * 12/2001 Gibble ..... B25H 1/0092 408/16
7,127,969 B2 * 10/2006 Hsieh ..... B25B 13/06 81/121.1
7,153,214 B2 * 12/2006 Delaney ..... B25B 13/06 464/159
7,159,491 B1 * 1/2007 Chaconas ..... B25B 13/06 81/124.3
7,987,748 B2 * 8/2011 Chiu ..... B25B 13/06 81/119
8,678,262 B2 * 3/2014 Zhou ..... B25C 1/06 227/113
8,840,344 B2 * 9/2014 Stenman ..... B23B 51/05 408/186
9,566,692 B2 * 2/2017 Seith ..... B25B 13/06
2004/0074344 A1 * 4/2004 Carroll ..... B25B 13/06 81/121.1
2004/0240954 A1 * 12/2004 Chilcott ..... E21B 7/008 408/239 A
2005/0105980 A1 * 5/2005 Davis ..... B23B 51/0433 408/199
2010/0000749 A1 * 1/2010 Andel ..... B25B 21/02 173/48
2011/0236180 A1 * 9/2011 Nelson ..... F01C 13/02 415/1
2012/0152067 A1 * 6/2012 Yoshimachi ..... B25B 13/06 81/57.36
2012/0170246 A1 * 7/2012 Huang ..... B23B 47/00 362/89
2012/0255403 A1 * 10/2012 Ehlers ..... B25B 13/06 81/467
2012/0255749 A1 10/2012 Seith et al.
2012/0279736 A1 * 11/2012 Tanimoto ..... B25B 21/02 173/2
2013/0277065 A1 * 10/2013 Hallundbæk ..... E21B 43/121 166/372
2015/0217431 A1 * 8/2015 Seith ..... B25B 13/06 81/121.1
2015/0217433 A1 * 8/2015 Seith ..... B25B 23/0035 81/124.6
2017/0021478 A1 * 1/2017 Junkers ..... B25B 21/002
2017/0028537 A1 * 2/2017 McClung ..... B25B 21/026
2017/0297179 A1 * 10/2017 Hsieh ..... B25B 21/02
2018/0117745 A1 * 5/2018 Murakami ..... B25D 11/04
2018/0193987 A1 * 7/2018 Hsieh ..... B25B 13/06
2018/0326564 A1 * 11/2018 Rettler ..... B25B 21/007

* cited by examiner

ROTATABLE FASTENING DEVICE

RELATED APPLICATIONS

This application claims priority to Taiwan Application Serial Number 105111503, filed Apr. 13, 2016, which is herein incorporated by reference.

BACKGROUND

Technical Field

The present disclosure relates to a rotatable tool. More particularly, the present disclosure relates to a rotatable fastening device for tighten rotation and relax rotation.

Description of Related Art

Hand tool products in recent years toward the development of lightweight, therefore the common rotary fastening tools are necessary to satisfy the market demand for lightweight and compact. For the rotary fastening operations, whether it is rotating screws, nuts or other fastening components, those fastening operations require a certain amount of a final fastening torque for rotation to ensure the fastening. Familiar rotary fastening tools when fastening devices such as an electric wrench fits sleeve, the electric wrench is limited by an electric motor of the electric wrenches that has a fixed maximum torque. Therefore, the existing electric wrench on the market is difficult to satisfy the miniaturization, light weighting, and maintain better fastening force needs.

On the other hand, although an air impact wrench has a high torque to achieve a higher fastening force of demand, but the conventional air impact wrench needs to fit a pump and a pipeline, and the air impact wrench has a large cylinder. Therefore, the volume of the air impact wrench can't be reduced in size. The preceding question of the conventional air impact wrench is also difficult to satisfy the miniaturization, light weighting, and maintain better fastening force needs.

In this respect, a Taiwan, R.O.C patent (TWI520817) has developed a torque control and torque control method of a power tool. The power tool has a motor, a speed gearbox, a driving axis, a percussion unit, and a control system. The percussion unit includes an output axis and a hammer. The speed gearbox is connected to one end of the motor to change the rotation of the motor. The driving axis is connected to the speed gearbox, and the driving axis is rotatable connected to one end of the output axis. The output axis of the power tool can connect to a screwdriver or a socket wrench. The hammer is located at the driving axis, and the hammer can reciprocate displacement along the axis direction of the driving axis. The end of the output axis and the hammer respectively correspond, and the output axis has a hit block and the hammer has another hit block. The two hit blocks can hit each other for generating a tangent impact force when the power tool is locking a screw or a nut.

Aforesaid patented technology can reach a greater fastening torque of demand, however, its structure has numerous complex elements. Therefore, the power tool can't operate different types of processing machines and operate the hammer or the hit block for quick-release. When the aforesaid patented technology is operating a rotatable releasing work, the hammer and the hit block will be a waste of the user's physical strength and driving energy. Therefore, aforesaid patented technology still does not meet the market demand for miniaturization and light weighting.

Further, an U.S. patent (US 20120255749 A1) presented a sleeve which is integrated with a ring member to provide fastening torque. However, the sleeve has a defect that the ring member can't be stripped rapidly even though the mechanism of it has been simplified. Moreover, the ring member of the familiar sleeve is difficult to produce and takes up a lot of space for storage.

Hence, the issue of how to make the rotary fastening tools lightweight, compact and with better fastening force interests the wrench developers and the machine tool manufacturers.

SUMMARY

According to an embodiment of the present disclosure, a rotatable fastening device is connected between a driving tool and a rotatable member, the rotatable fastening device includes a rotatable base and an impact member. The rotatable base rotates along a pivoting axis and has a driving end and a fastening end. The driving end is removably connected to the driving tool. The fastening end is removably connected, with, and driving the rotatable member.

According to another embodiment of the present disclosure, a rotatable fastening device includes a rotatable base and an impact member. The rotatable base rotates along a pivoting axis, and the rotatable base is removably connected with and driving a rotatable member. The impact member is removably connected to an outside of the rotatable base, and the impact member has at least one gravity unit projected outwardly therefrom. The gravity unit is driven by the rotatable base to rotate around the pivoting axis for generating a tangent impact force.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1:
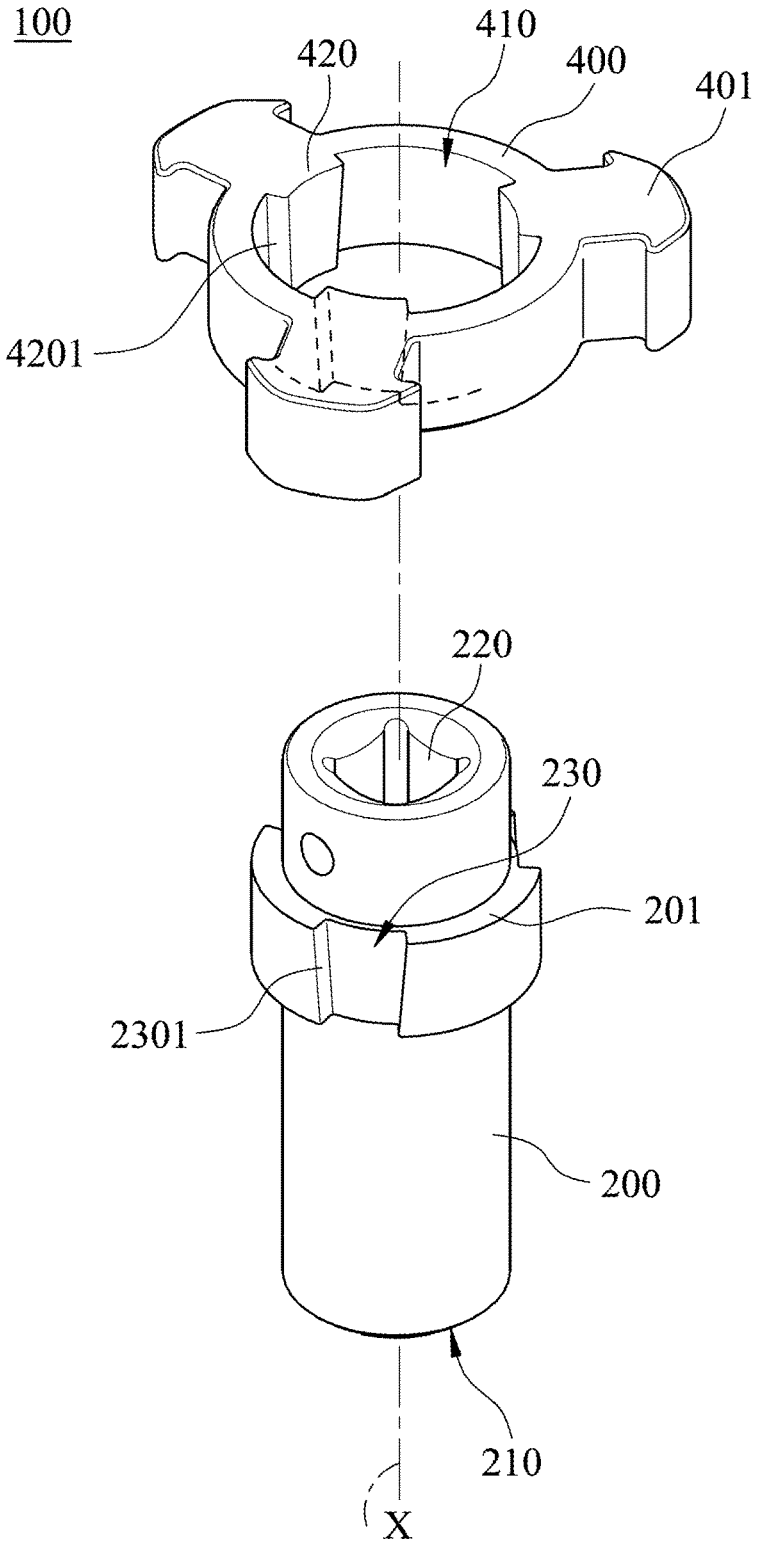
FIG. 1 is an exploded view of the first embodiment of the present disclosure.
Figure 2:
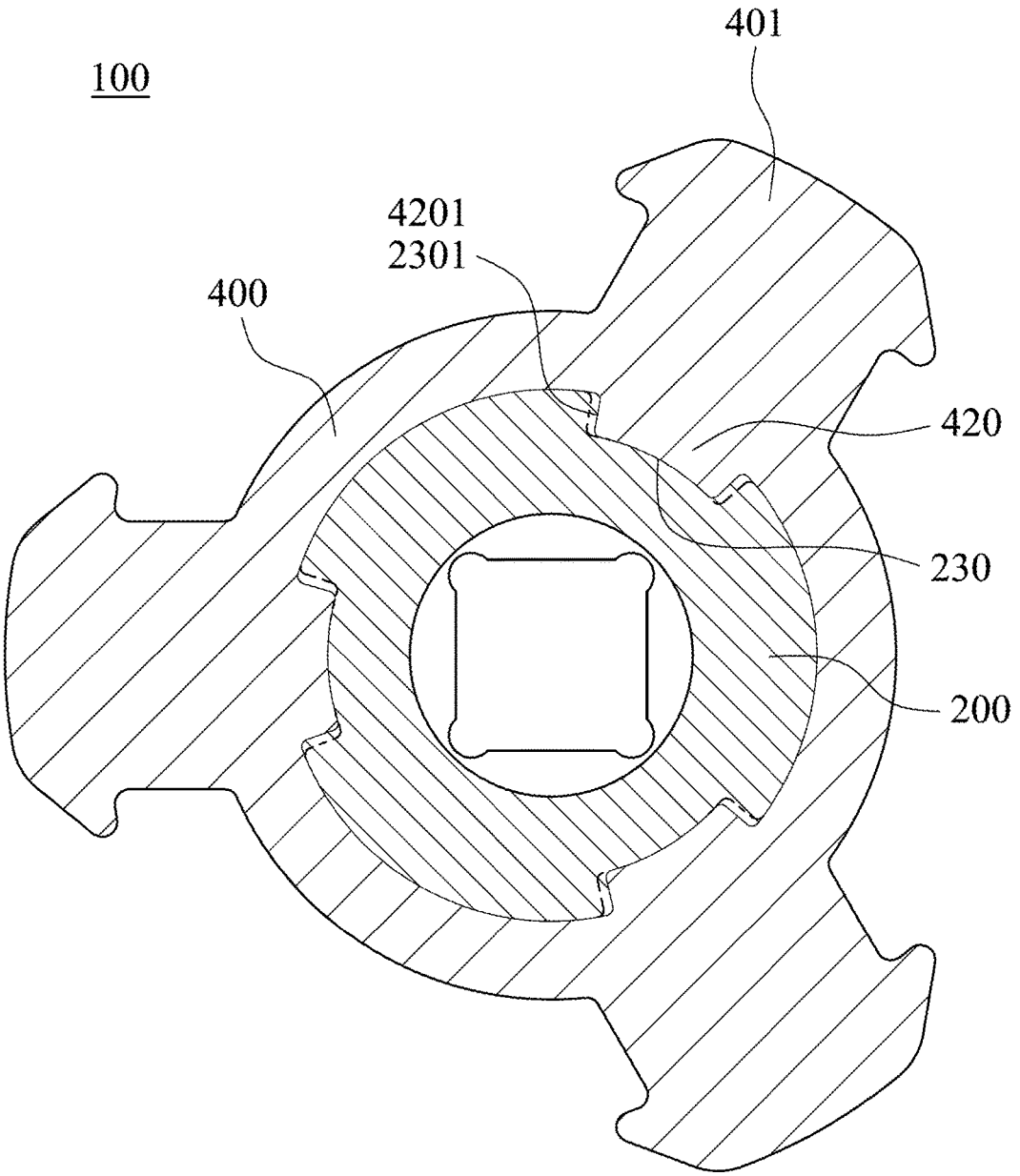
FIG. 2 is a cross-sectional view of the embodiment of FIG. 1.
Figure 3:
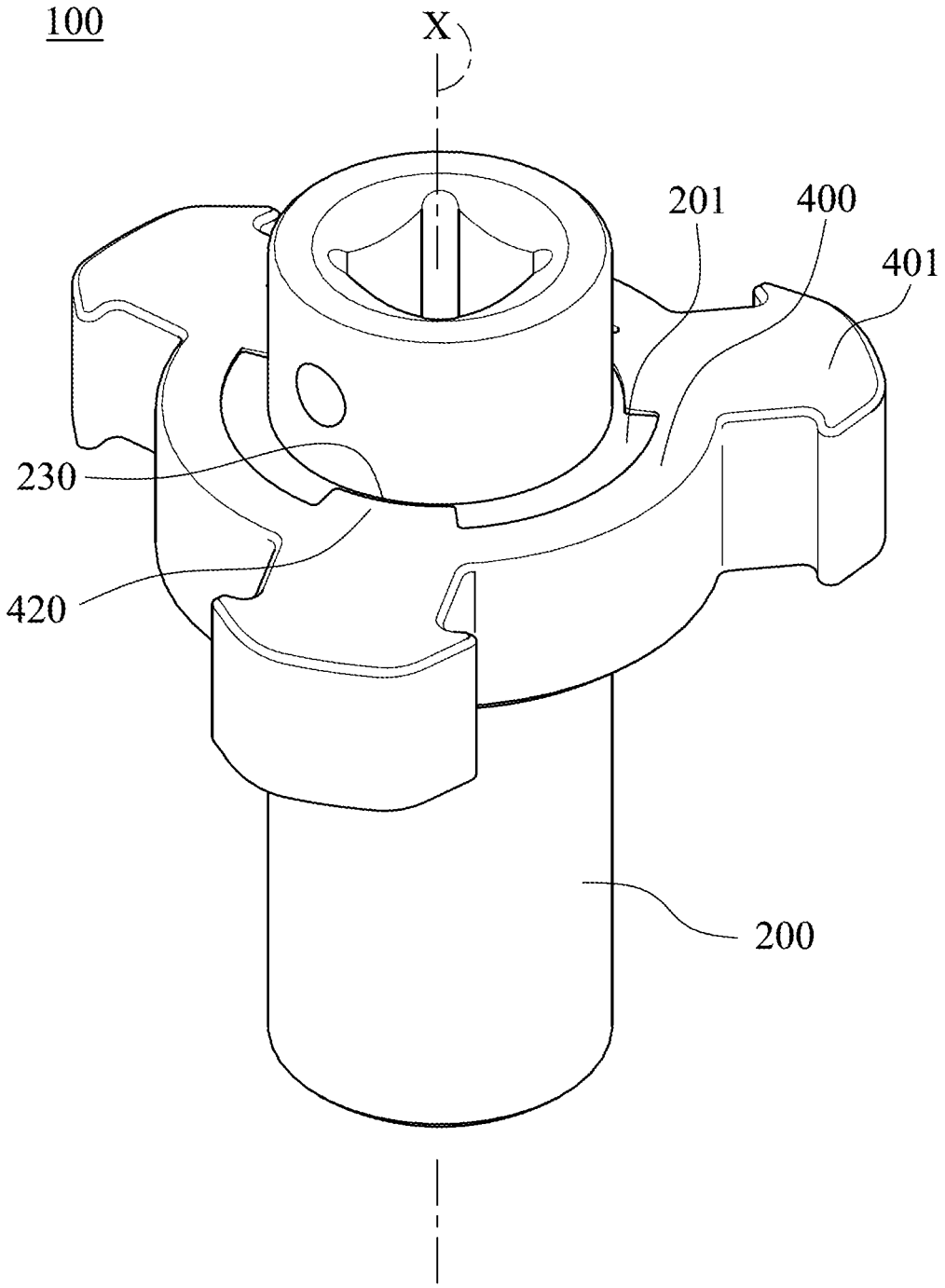
FIG. 3 is a perspective view of the embodiment of FIG. 1.
Figure 4:
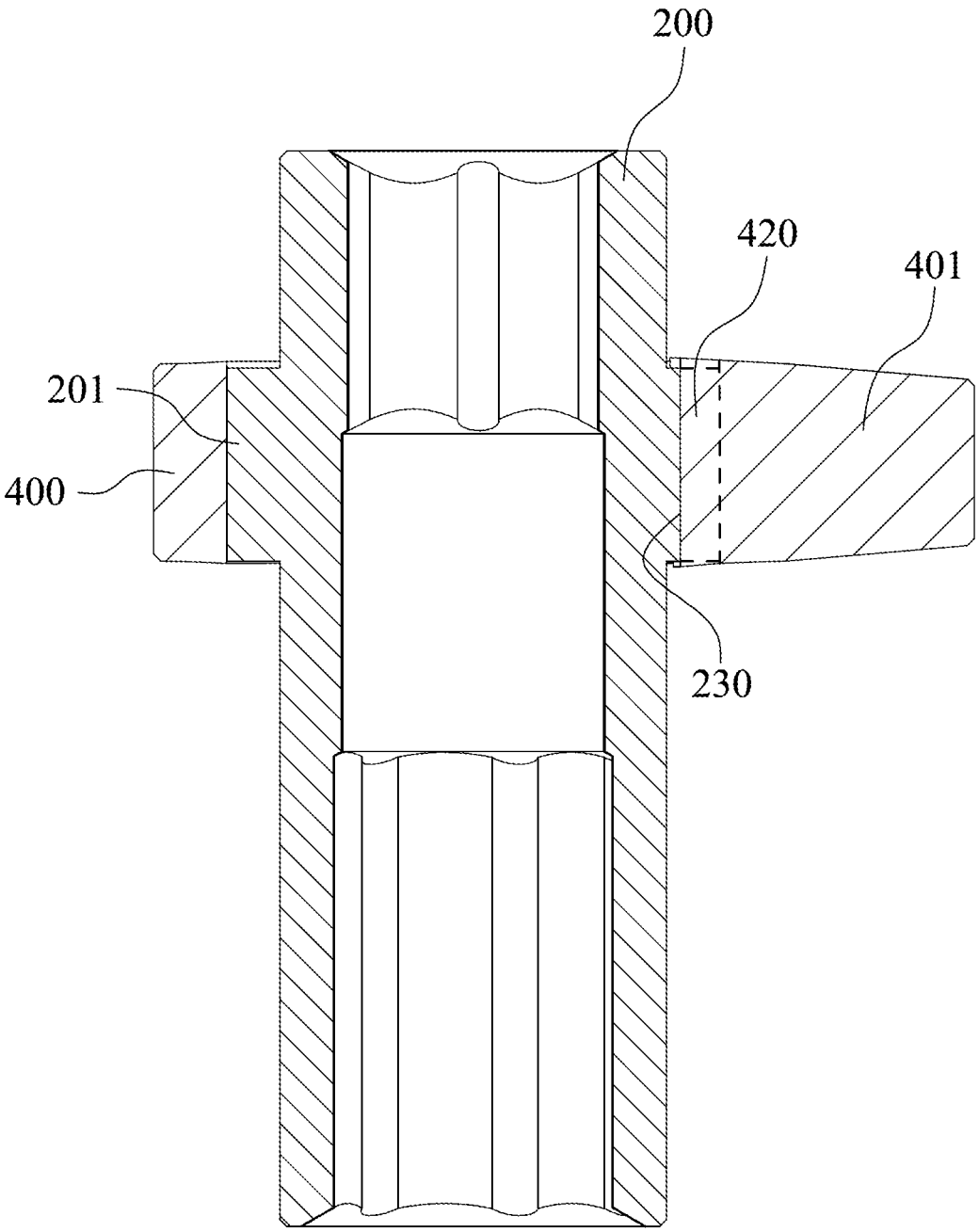
FIG. 4 is a vertical-sectional view of the embodiment of FIG. 1.

FIG. 1 is an exploded view of the first embodiment of the present disclosure. FIG. 2 is a cross-sectional view of the embodiment of FIG. 1. FIG. 3 is a perspective view of the embodiment of FIG. 1. FIG. 4 is a vertical-sectional view of the embodiment of FIG. 1.

In FIG. 1, FIG. 2, FIG. 3 and FIG. 4, the rotatable fastening device 100 includes a rotatable base 200 and an impact member 400.

The rotatable base 200 is a rod shape at the front, and the rotatable base 200 has a fastening end 210 and a driving end 220 at two ends therefrom respectively. The fastening end 210 is a hex socket and removably connects and drives a rotatable member (not labeled), e.g., a screw, a nut or a lead screw. The driving end 220 is with a square socket for positioning so as to drive an electric wrench, an air wrench or a torque wrench. The rotatable base 200 rotates around a pivoting axis X, and the rotatable base 200 has a bump 201 and three engaged seats 230 equidistantly surround the pivoting axis X. Each of the engaged seats 230 is a trapezoid space that expands outwardly and with two bevels 2301 on both sides.

The impact member 400 is a ring shape and with an engaged slot 410 at the center, and the engaged slot 410 has three engaged units 420 which are trapezoids and expand outwardly. The three engaged units 420 are disposed equidistantly and surround the inner side of the engaged slot 410. Each of the engaged units 420 is with two bevels 4201 on both sides. One of the engaged units 420 is removably connected with one of the engaged seats 230 that both shapes are corresponded to each other. Moreover, the two bevels 4201 are tightly fitted with the two bevels 2301 during the rotating so to enhance the stability of positioning between the rotatable base 200 and the impact member 400, therefore the impact member 400 can be sleeved on and rotated by the rotatable base 200. The impact member 400 has three gravity units 401 which are arrow-shape on outer side, and the gravity units 401 are to provide an energy for rotation by the weight thereof. The energy is used to generate greater torque for tightening operation.

Figure 5:
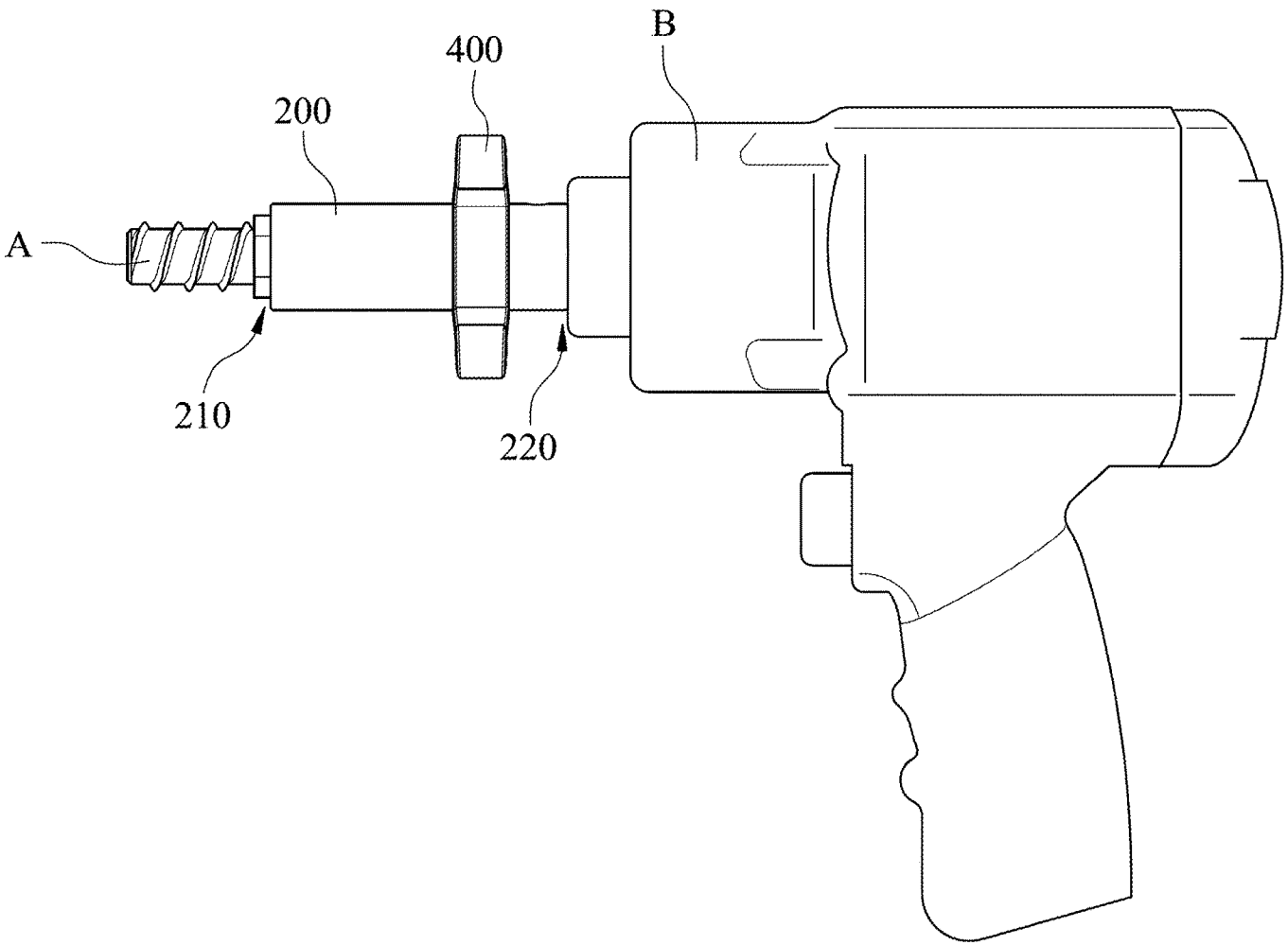
FIG. 5 is a schematic view of an operation of the embodiment of FIG. 1.

FIG. 5 is a schematic view of the operation of the embodiment of FIG. 1. In FIG. 5, the fastening end 210 of the rotatable base 200 connects and drives a screw A, the driving end 220 is driven by an electric wrench B to tighten the screw A at high speed.

Figure 6:
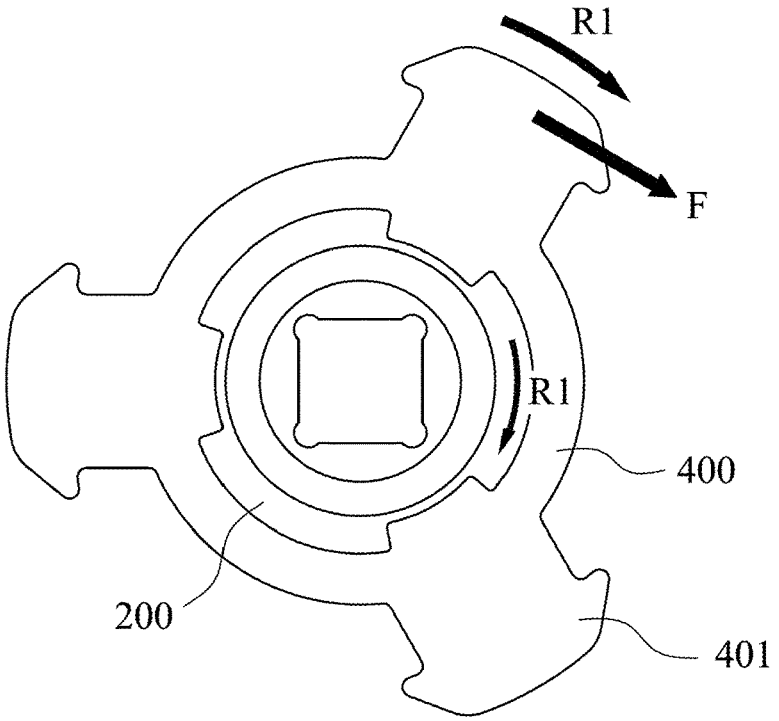
FIG. 6 is a schematic view before impacting of the embodiment of FIG. 1.

FIG. 6 is a schematic view before impacting of the embodiment of FIG. 1. In FIG. 6, the impact member 400 is driven by the rotatable base 200 to rotate when the electric wrench B drives the rotatable base 200 along a first rotating direction R1 (the direction to tighten the screw A). Accordingly, the three gravity units 401 that are disposed on the outer side of the impact member 400 rotate along the first rotating direction R1 at high speed, so as to generate a tangent impact force F surrounds the pivoting axis X.

Figure 7:
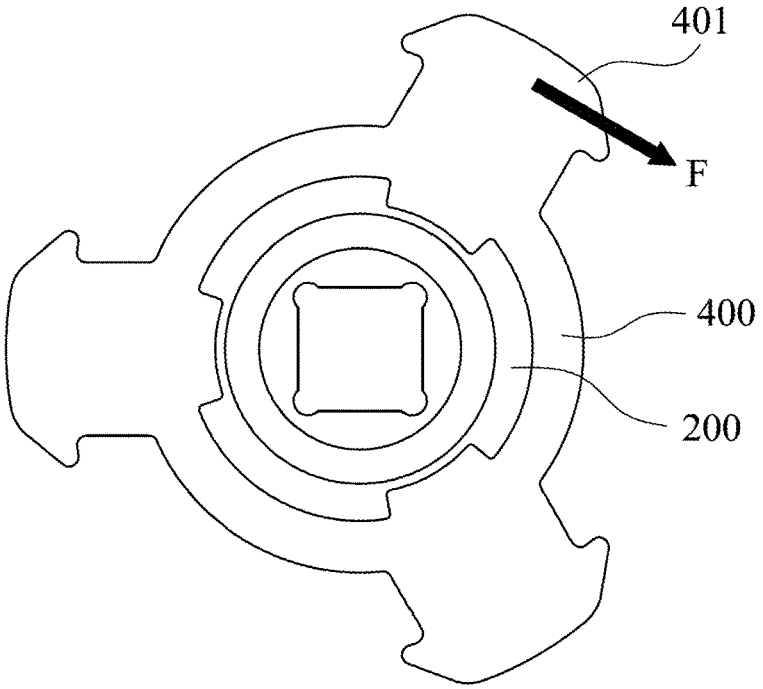
FIG. 7 is a schematic view after impacting of the embodiment of FIG. 1.

FIG. 7 is a schematic view after impacting of the embodiment of FIG. 1. In FIG. 7, when the rotatable base 200 is tightening the screw A with the electric wrench B, the electric wrench B tightens the screw A to the limit of the torque at the time that the screw A stops to rotate. In the circumstance, the screw A is impacted by the tangent impact force F which provides an instant torque acted on the rotatable base 200, therefore the performance for tightening of the screw A can be enhanced.

Further, the impact member 400 can be stripped from the rotatable base 200 when impacted from the narrow side at the bottom to the broad side at the top of the engaged units 420. Hence, when rotating along a second rotating direction, e.g., to loosen the rotatable member the rotatable base 200 is not affected by the impact member 400 which may cause a reverse impact.

When the driving tool rotates along the second rotating direction, the impact member 400 also provides a reverse torque to enhance the loosening by inertia. Therefore, the driving tool is also suitable to loosen the screws or the nuts that froze up with rust.

Figure 8:
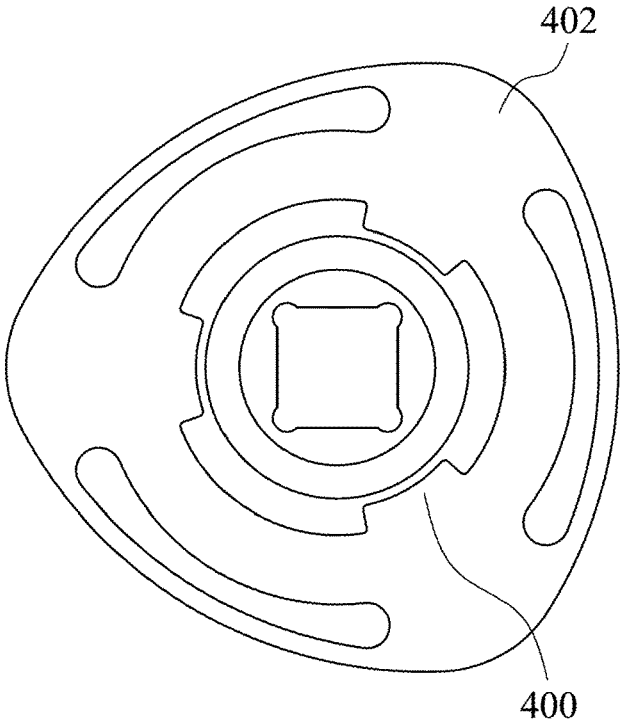
FIG. 8 is a schematic view of the second embodiment of the present disclosure.
Figure 9:
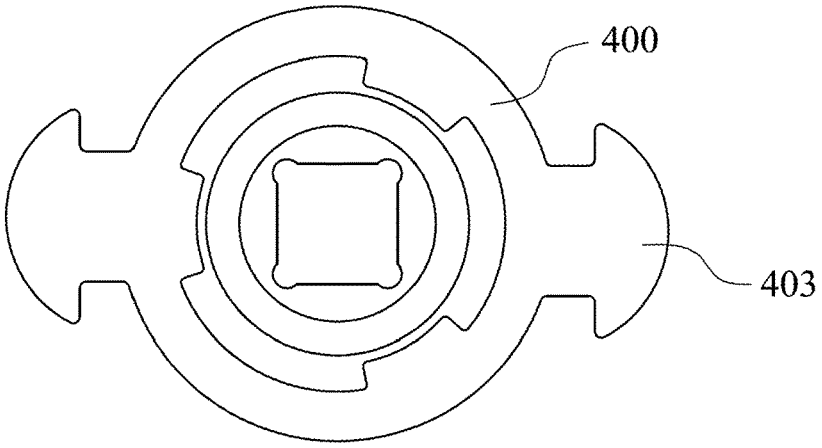
FIG. 9 is a schematic view of the third embodiment of the present disclosure.

FIG. 8 is a schematic view of the second embodiment of the present disclosure. In FIG. 8, the impact member 400 can be integrated with a triangular ingot 402 to generate energy when rotating so that to provide the tangent impact force F. FIG. 9 is a schematic view of the third embodiment of the present disclosure. In FIG. 9, the impact member 400 can be integrated with two rods 403 which are opposite in direction. In addition, the impact member 400 can be integrated with a curved ingot shape or a radiation convex shape. The change in shape of the impact member 400 will not be a limitation to the present disclosure since the preceding change can be achieved by a person has the normal skit s and knowledge in the technical field.

According to the foregoing embodiment, the advantages of the present disclosure are described as follows. 1. The present disclosure provides tangent impact forces to enhance the performance of tightening or loosening in two directions with less and smaller members, so as to satisfy the demand for lightweight, compact, moreover to provide multiple selections for assembly to the rotatable tool. 2. The impact member can be stripped when the rotatable base is driven to loosen, therefore the impact member does not affect the operation for tightening or loosening nor cause a reverse impact in an accident. 3. Because of the removability, the shape of the impact member is variable for different demand of tangent impact force, so the rotatable tool is suitable for various applications.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A rotatable fastening device connected between a driving tool and a rotatable member, the rotatable fastening device comprising:

a rotatable base rotating along an axis, and the rotatable base having a driving end and a fastening end, the driving end removably connected to the driving tool, and the fastening end removably connected with and driving the rotatable member; and an impact member removably connected to an outside of the rotatable base, and the impact member having at least one gravity unit projected outwardly therefrom, the gravity unit driven by the rotatable base to rotate around the axis for generating a tangent impact force;

wherein the rotatable base has at least two engaged seats, and the two engaged seats are equidistantly and symmetrically surround the axis, the impact member has two engaged units that are corresponding to and engaged with the two engaged seats.

2. The rotatable fastening device of claim 1, wherein one of the two engaged units has a convex shape toward the axis, and one of the two engaged seats has a concave shape on an outer surface of the rotatable base.

3. The rotatable fastening device of claim 2, wherein the convex shape of the engaged unit is a curve, and the concave shape of the engaged seat is a curve.

4. The rotatable fastening device of claim 3, wherein the convex shape of the engaged unit has two bevels, and the concave shape of the engaged seat has two bevels.

5. The rotatable fastening device of claim 1, wherein the impact member is integrated with the gravity unit, and a shape of the gravity unit is a curved ingot shape, a triangular ingot shape, a rod shape, or a radiation convex shape.

6. The rotatable fastening device of claim 1, wherein the rotatable fastening device is a sleeve.

7. A rotatable fastening device comprising:

a rotatable base rotating along an axis, and the rotatable base removably connected with and driving a rotatable member; and an impact member removably connected to an outside of the rotatable base, and the impact member having at least one gravity unit projected outwardly therefrom, the gravity unit driven by the rotatable base to rotate around the axis for generating a tangent impact force;

wherein the rotatable base has at least an engaged seat, and the impact member has an engaged unit that is corresponding to and engaged with the engaged seat.

8. The rotatable fastening device of claim 7, wherein the impact member is integrated with the gravity unit, and a shape of the gravity unit is a curved ingot shape, a triangular ingot shape, a rod shape, or a radiation convex shape.

9. The rotatable fastening device of claim 7, wherein the rotatable base has three engaged seats and the impact member has three engaged units, the three engaged seats or the three engaged units are equidistantly and symmetrically surround the axis.

10. The rotatable fastening device of claim 7, wherein the rotatable fastening device is a sleeve.

* * * * *